US007678747B2

(12) United States Patent
Roby et al.

(10) Patent No.: US 7,678,747 B2
(45) Date of Patent: Mar. 16, 2010

(54) ENGINE OIL COMPOSITIONS

(75) Inventors: Stephen H. Roby, Hercules, CA (US); Susanne G. Ruelas, San Pablo, CA (US)

(73) Assignee: Cherron Oronite Company LLC, San Ramon, CA (US)

( * ) Notice: Subject to any disclaimer, the term of this patent is extended or adjusted under 35 U.S.C. 154(b) by 0 days.

(21) Appl. No.: 12/384,146

(22) Filed: Apr. 1, 2009

(65) Prior Publication Data

US 2009/0197783 A1 Aug. 6, 2009

Related U.S. Application Data

(63) Continuation of application No. 10/674,643, filed on Sep. 30, 2003.

(51) Int. Cl.

| | |
|---|---|
| ***C01M 129/74*** | (2006.01) |
| ***C01M 101/04*** | (2006.01) |
| ***C01M 105/00*** | (2006.01) |
| ***C01M 159/08*** | (2006.01) |
| ***C01M 159/12*** | (2006.01) |
| ***C01M 169/04*** | (2006.01) |

(52) U.S. Cl. ..... 508/486; 508/485; 508/491

(58) Field of Classification Search ..... 508/485, 508/486, 491

See application file for complete search history.

(56) References Cited

U.S. PATENT DOCUMENTS

| | | | | |
|---|---|---|---|---|
| 5,151,205 | A * | 9/1992 | Culpon, Jr. | 508/485 |
| 5,338,471 | A * | 8/1994 | Lal | 508/186 |
| 6,465,401 | B1 * | 10/2002 | Kodali et al. | 508/488 |
| 6,943,262 | B2 * | 9/2005 | Kodali et al. | 554/169 |
| 2003/0176300 | A1 * | 9/2003 | Kodali et al. | 508/452 |
| 2003/0186824 | A1 * | 10/2003 | Chiu et al. | 508/490 |

* cited by examiner

*Primary Examiner*—Joseph D Anthony
(74) *Attorney, Agent, or Firm*—Claude J. Caroli; M. Carmen & Associates, PLLC

(57) ABSTRACT

A lubricating oil composition comprising (a) a major amount of a base oil of lubricating viscosity and (b) a minor deposit-inhibiting effective amount of a reaction product prepared by transesterifying at least one glycerol ester and at least one non-glycerol polyol ester is provided. Methods for its use are also provided.

22 Claims, No Drawings

ENGINE OIL COMPOSITIONS

PRIORITY

This application is a continuation of co-pending U.S. patent application Ser. No. 10/674,643, filed Sep. 30, 2003, the contents of which are incorporated herein by reference.

BACKGROUND OF THE INVENTION

1. Technical Field

The present invention relates generally to improved lubricating oil compositions containing additives and additive mixtures for use in internal combustion engines 2. Description of the Related Art Automobile spark ignition and diesel engines have valve train systems, including valves, cams and rocker arms which present special lubrication concerns. It is extremely important that the lubricant, i.e., the engine oil, protects these parts from wear. It is also important for engine oils to suppress the production of deposits in the engines. Such deposits are produced from non-combustibles and incomplete combustion of hydrocarbon fuels (e.g., gasoline, diesel fuel oil) and by the deterioration of the engine oil employed.

Engine oils typically use a mineral oil or a synthetic oil as a base oil. However, simple base oils alone do not provide the necessary properties to provide adequate wear protection, deposit control, etc. required to protect internal combustion engines. Thus, base oils are formulated with various additives (for imparting auxiliary functions) such as, for example, ashless dispersants, metallic detergents (i.e., metal-containing detergents), antiwear agents, antioxidants (i.e., oxidation inhibitors), viscosity index improvers and the like to produce a compounded oil, i.e., a lubricating oil composition.

A number of such engine oil additives are known and employed in practice. The most common additive for engine lubricating oils has been zinc dialkyldithiophosphates because of their favorable characteristics as an antiwear agent and performance as an oxidation inhibitor. However, a problem has arisen with respect to the use of zinc dialkyldithiophosphate, because phosphorous and sulfur derivatives poison catalyst components of catalytic converters. This is a major concern as effective catalytic converters are needed to reduce pollution and to meet governmental regulations designed to reduce toxic gases such as, for example, hydrocarbons, carbon monoxide and nitrogen oxides, in internal combustion engine exhaust emission. Such catalytic converters generally use a combination of catalytic metals, e.g., platinum or variations, and metal oxides, and are installed in the exhaust streams, e.g., the exhaust pipes of automobiles, to convert the toxic gases to nontoxic gases. As previously mentioned, these catalyst components are poisoned by the phosphorous and sulfur components, or the phosphorous and sulfur decomposition product of the zinc dialkyldithiophosphate; and accordingly, the use of engine oils containing phosphorous and sulfur additives may substantially reduce the life and effectiveness of catalytic converters. Therefore, it would be desirable to reduce the phosphorous and sulfur content in the engine oils so as to maintain the activity and extend the life of the catalytic converter.

There is also governmental and automotive industry pressure towards reducing the phosphorous and sulfur content. For example, United States Military Standards MIL-L-46152E and the ILSAC Standards defined by the Japanese and United States Automobile Industry Association at present require the phosphorous content of engine oils to be at or below 0.10 wt. % with future phosphorous content being proposed to even lower levels, e.g., 0.08 wt. % by January, 2004 and below 0.05 wt. % by January, 2006. At present, there is no industry standard requirement for sulfur content in engine oils, but it has been proposed that the sulfur content be below 0.2 wt. % by January, 2006. Accordingly, it would be desirable to decrease the amount of zinc dialkyldithiophosphate in lubricating oils still further, thus reducing catalyst deactivation and hence increasing the life and effectiveness of catalytic converters while also meeting future industry standard proposed phosphorous and sulfur contents in the engine oil. However, simply decreasing the amount of zinc dialkyldithiophosphate presents problems because this necessarily lowers the antiwear properties and oxidation inhibition properties of the lubricating oil. Therefore, it is necessary to find a way to reduce phosphorous and sulfur content while still retaining the antiwear and oxidation or corrosion inhibiting properties of the higher phosphorous and sulfur content engine oils.

In order to compensate for lowering the amount of zinc dialkyldithiophosphate, other oxidation inhibitors such as phenol derivatives, e.g., high overbased phenates, and ashless antioxidants, e.g., alkylated diphenylamines, have been used. However, the use of such known oxidation inhibitors in place of zinc dialkyldithiophosphate at best only marginally satisfies the required levels of antiwear, oxidation inhibition and deposit control.

Detergents have been added to impart a total base number (TBN) to neutralize acidic combustion products and to clean surfaces containing deposits. However, detergents may impart undesirable properties. For example, overbased sulfonates such as magnesium sulfonate detergents are also effective to enhance the antiwear properties in valve train systems, but have drawbacks in that crystalline precipitates are sometimes produced when these engine oils are stored under humid or variable temperature conditions for a long period of time. Such precipitates may cause plugging of the filter which is installed in the engine oil circulating system. Such plugging is more likely to occur when a large amount of the magnesium sulfonate detergents is used to enhance the desired antiwear properties. Additionally, the use of high overbased detergents such as, for example, sulfonates or phenates, and low overbased sulfonates contribute toward the sulfur content which, as previously mentioned, has been proposed for significant reduction in the levels contained in the lubricating oils.

Accordingly, as demand for further decrease of the phosphorous content and a limit on the sulfur content of lubricating oils is very high, this reduction cannot be satisfied by the present measures in practice and still meet the severe antiwear and oxidation-corrosion inhibiting properties, as well as cleanliness (i.e., deposit protection) required of today's engine oils. Thus, it would be desirable to develop lubricating oils, and additives and additive packages therefore, having lower levels of phosphorous and sulfur but which still provide the needed wear, oxidation-corrosion and deposit protection now provided by lubricating oils having, for example, higher levels of zinc dialkyldithiophosphate, but which do not suffer from the disadvantages of the lubricating oils discussed above.

U.S. Pat. No. 6,278,006 discloses transesterifying triacylglycerol containing oils, e.g., vegetable oils, with short saturated fatty acid polyol esters to obtain an oil having improved lubrication properties. The patent further discloses that the oils can also contain various other additives such as, for example, antioxidants, anti-foam additives, anti-wear additives, corrosion inhibitors, dispersants and detergents.

SUMMARY OF THE INVENTION

In accordance with the present invention, lubricating oil compositions having high antiwear, oxidation-corrosion and deposit protection, but which have low levels of phosphorous and sulfur, are provided. In one embodiment of the present invention, a lubricating oil composition is provided comprising (a) a major amount of a base oil of lubricating viscosity and (b) a minor deposit-inhibiting effective amount of a reaction product prepared by transesterifying at least one glycerol ester and at least one non-glycerol polyol ester.

In a second embodiment of the present invention, a lubricating oil composition is provided comprising (a) a major amount of a base oil of lubricating viscosity and (b) a minor deposit-inhibiting effective amount of a reaction product of at least one first polyol ester of the general formula:

(I)

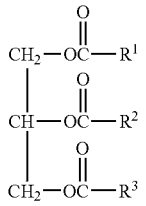

wherein $R^1$, $R^2$ and $R^3$ are independently aliphatic hydrocarbyl moieties having 4 to about 75 carbon atoms; and at least one second polyol ester of the general formula:

(II)

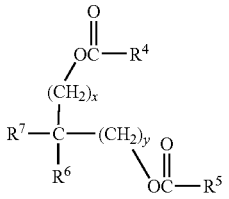

wherein x and y are the same or different and are integers from 1 to 6, $R^4$ and $R^5$ are independently aliphatic hydrocarbyl moieties having 4 to 24 carbon atoms and $R^6$ and $R^7$ are independently hydrogen, an aliphatic hydrocarbyl moiety having 1 to 10 carbon atoms or

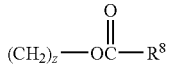

wherein z is an integer from 0 to 6 and $R^8$ is an aliphatic hydrocarbyl moiety having 4 to 24 carbon atoms.

In a third embodiment of the present invention, a method of operating an internal combustion engine is provided comprising operating the internal combustion engine with a lubricating oil composition comprising (a) a major amount of a base oil of lubricating viscosity and (b) a minor deposit-inhibiting effective amount of the foregoing reaction products.

In another embodiment of the present invention, a low-phosphorous or phosphorous-free lubricating oil composition is provided comprising (a) a major amount of a base oil of lubricating viscosity and (b) a minor deposit-inhibiting effective amount of the foregoing reaction products; wherein the composition has a phosphorous content not exceeding 0.08% by weight, based on the total weight of the composition.

Yet another embodiment of the present invention is a method of operating an internal combustion engine comprising operating the internal combustion engine with a low-phosphorous or phosphorous-free lubricating oil composition comprising (a) a major amount of a base oil of lubricating viscosity and (b) a minor deposit-inhibiting effective amount of the foregoing reaction products; wherein the composition has a phosphorous content not exceeding 0.08% by weight, based on the total weight of the composition.

In another aspect of the present invention, an additive package composition or concentrate is provided comprising one or more of the foregoing reaction products in an organic diluent liquid and preferably containing various other additives desired in lubricating oil compositions such as, for example, metal-containing detergents and ashless dispersants.

The term "glyceride" as used herein refers to glycerides that are derived from natural, i.e., animal or plant, sources, and to glycerides that are synthetically produced. Glycerides are esters of glycerol (a trihydric alcohol) and fatty acids in which one or more of the hydroxyl groups of glycerol are esterified with the carboxyl groups of fatty acids containing from about 4 to about 75 carbon atoms and preferably from about 6 to about 24 carbon atoms. The fatty acids can be saturated or unsaturated, linear, branched or cyclic monocarboxylic acids. Where three hydroxyl groups are esterified, the resulting glyceride is denoted a "triglyceride". When only one or two of the hydroxyl groups are esterified, the resulting products are denoted "monoglycerides" and "diglycerides", respectively. Natural glycerides are mixed glycerides comprising triglycerides and minor amounts, e.g., from about 0.1 to about 40 mole percent, of mono- and diglycerides. Natural glycerides include, e.g., coconut and soybean oils. Synthetically produced glycerides are synthesized by the condensation reaction between glycerol and a fatty acid or mixture of fatty acids containing from about 6 to about 24 carbon atoms. The fatty acid can be a saturated or unsaturated, linear, branched or cyclic monocarboxylic acid or mixture thereof. The fatty acid itself can be derived from, for example, natural, i.e., plant or animal, sources. Examples include, but are not limited to, caproic, caprylic, capric, lauric, myristic, palmitic, stearic, arachidic, oleic, linoleic and linolenic acids, and mixtures of any of the foregoing. The synthetically produced glycerides will contain from about 80 to about 100 mole percent triglycerides with the balance, if any, representing from about 0 to about 20 mole percent mono and di-glycerides, present in admixture with triglycerides.

The present invention advantageously provides lubricating oil compositions which provide deposit protection in addition to high antiwear and oxidation-corrosion protection. The lubricating oil compositions can also provide such protection while having only low levels of phosphorous, i.e., less than 0.1%, preferably not exceeding 0.08% and more preferably not exceeding 0.05% by weight and low levels of sulfur, i.e., not exceeding 0.2% by weight, based on the total weight of the composition. Accordingly, the lubricating oil compositions of the present invention can be more environmentally desirable than the higher phosphorous and sulfur lubricating oil compositions generally used in internal combustion engines because they facilitate longer catalytic converter life and activity while also providing the desired high deposit protection. This is due to the substantial absence of additives containing phosphorus and sulfur compounds in these lubricating oil compositions. Conventional lubricating oil compositions, on the other hand, typically contain relatively high concentrations of such additives.

DETAILED DESCRIPTION OF THE PREFERRED EMBODIMENTS

It has been found that the incorporation of a minor deposit-inhibiting effective amount of the foregoing reaction products into a major amount of a base oil of lubricating viscosity advantageously provides excellent deposit protection in internal combustion engines. It has also been found that these results can be achieved in lubricating oil compositions having low levels of phosphorous-containing additives, e.g., zinc dialkyldithiophosphates, and low levels of sulfur-containing additives, e.g., high overbased sulfonates, low overbased sulfonates such as magnesium sulfonate detergents, etc. However, the sulfur in the inventive lubricating oil composition may be in any form. For example, the sulfur may be elemental sulfur or it may be present in the lubricating oil composition or added to the lubricating oil composition as part of a sulfur-containing compound. The sulfur-containing compound may be an inorganic sulfur compound or an organic sulfur compound. The sulfur-containing compound may be a compound containing one or more of the groups: sulfamoyl, sulfenamoyl, sulfeno, sulfido, sulfinamoyl, sulfino, sulfinyl, sulfo, sulfonio, sulfonyl, sulfonyldioxy, sulfate, thio, thiocarbamoyl, thiocarbonyl, thiocarbonylamino, thiocarboxy, thiocyanato, thioformyl, thioxo, thioketone, thioaldehyde, thioester, and the like. The sulfur may also be present in a hetero group or compound which contains carbon atoms and sulfur atoms (and, optionally, other hetero atoms such as oxygen or nitrogen) in a chain or ring. The sulfur-containing compound may be a sulfur oxide such as sulfur dioxide or sulfur trioxide. The sulfur or sulfur-containing compound may be intentionally added to the inventive lubricating oil composition, or it may be present in the base oil or in one or more of the additives for the inventive lubricating oil composition as an impurity.

The lubricating oil compositions of this invention include as a first component a major amount of base oil of lubricating viscosity, e.g., an amount of at least 40 wt. %, preferably about 85 to about 98 wt. % and preferably about 90 to about 95 wt. %, based on the total weight of the composition. The expression "base oil" as used herein shall be understood to mean a base stock or blend of base stocks which is a lubricant component that is produced by a single manufacturer to the same specifications (independent of feed source or manufacturer's location): that meets the same manufacturer's specification; and that is identified by a unique formula, product identification number, or both. Typically, individually the oils used as its base oil will have a kinematic viscosity range at 100° Centigrade (C) of about 2 centistokes (cSt) to about 20 cSt, preferably about 3 cSt to about 16 cSt, and most preferably about 4 cSt to about 12 cSt and will be selected or blended depending on the desired end use and the additives in the finished oil to give the desired grade of engine oil, e.g., a lubricating oil composition having an SAE Viscosity Grade of 0W, 0W-20, 0W-30, 0W-40, 0W-50, 0W-60, 5W, 5W-20, 5W-30, 5W-40, 5W-50, 5W-60, 10W, 10W-20, 10W-30, 10W-40, 10W-50, 15W, 15W-20, 15W-30 or 15W-40.

Base stocks may be manufactured using a variety of different processes including, but not limited to, distillation, solvent refining, hydrogen processing, oligomerization, esterification, and rerefining. Rerefined stock shall be substantially free from materials introduced through manufacturing, contamination, or previous use. The base oil of the lubricating oil compositions of this invention may be any natural or synthetic lubricating base oil. Suitable hydrocarbon synthetic oils include, but are not limited to, oils prepared from the polymerization of ethylene or from the polymerization of 1-olefins such as polyalphaolefin or PAO oils, or from hydrocarbon synthesis procedures using carbon monoxide and hydrogen gases such as in a Fisher-Tropsch process. A preferred base oil is one that comprises little, if any, heavy fraction; e.g., little, if any, lube oil fraction of viscosity 20 cSt or higher at 100° C.

The base oil may be derived from natural lubricating oils, synthetic lubricating oils or mixtures thereof. Suitable base oil includes base stocks obtained by isomerization of synthetic wax and slack wax, as well as hydrocracked base stocks produced by hydrocracking (rather than solvent extracting) the aromatic and polar components of the crude. Suitable base oils include those in all API categories I, II, III, IV and V as defined in API Publication 1509, 14th Edition, Addendum I, December 1998. Group IV base oils are polyalphaolefins (PAO). Group V base oils include all other base oils not included in Group I, II, III, or IV. Although Group II, III and IV base oils are preferred for use in this invention, these preferred base oils may be prepared by combining one or more of Group I, II, III, IV and V base stocks or base oils.

Useful natural oils include mineral lubricating oils such as, for example, liquid petroleum oils, solvent-treated or acid-treated mineral lubricating oils of the paraffinic, naphthenic or mixed paraffinic-naphthenic types, oils derived from coal or shale, animal oils, vegetable oils (e.g., rapeseed oils, castor oils and lard oil), and the like.

Useful synthetic lubricating oils include, but are not limited to, hydrocarbon oils and halo-substituted hydrocarbon oils such as polymerized and interpolymerized olefins, e.g., polybutylenes, polypropylenes, propylene-isobutylene copolymers, chlorinated polybutylenes, poly(1-hexenes), poly(1-octenes), poly(1-decenes), and the like and mixtures thereof; alkylbenzenes such as dodecylbenzenes, tetradecylbenzenes, dinonylbenzenes, di(2-ethylhexyl)-benzenes, and the like; polyphenyls such as biphenyls, terphenyls, alkylated polyphenyls, and the like; alkylated diphenyl ethers and alkylated diphenyl sulfides and the derivative, analogs and homologs thereof and the like.

Other useful synthetic lubricating oils include, but are not limited to, oils made by polymerizing olefins of less than 5 carbon atoms such as ethylene, propylene, butylenes, isobutene, pentene, and mixtures thereof. Methods of preparing such polymer oils are well known to those skilled in the art.

Additional useful synthetic hydrocarbon oils include liquid polymers of alpha olefins having the proper viscosity. Especially useful synthetic hydrocarbon oils are the hydrogenated liquid oligomers of $C_6$ to $C_{12}$ alpha olefins such as, for example, 1-decene trimer.

Another class of useful synthetic lubricating oils include, but are not limited to, alkylene oxide polymers, i.e., homopolymers, interpolymers, and derivatives thereof where the terminal hydroxyl groups have been modified by, for example, esterification or etherification. These oils are exemplified by the oils prepared through polymerization of ethylene oxide or propylene oxide, the alkyl and phenyl ethers of these polyoxyalkylene polymers (e.g., methyl poly propylene glycol ether having an average molecular weight of 1,000, diphenyl ether of polyethylene glycol having a molecular weight of 500-1000, diethyl ether of polypropylene glycol having a molecular weight of 1,000-1,500, etc.) or mono- and polycarboxylic esters thereof such as, for example, the acetic esters, mixed $C_3$-$C_8$ fatty acid esters, or the $C_{13}$oxo acid diester of tetraethylene glycol.

Yet another class of useful synthetic lubricating oils include, but are not limited to, the esters of dicarboxylic acids e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acids, alkyl malonic acids, alkenyl malonic acids, etc., with a variety of alcohols, e.g., butyl alcohol, hexyl alcohol, dodecyl alcohol, 2-ethylhexyl alcohol, ethylene glycol, diethylene glycol monoether, propylene glycol, etc. Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include, but are not limited to, those made from carboxylic acids having from about 5 to about 12 carbon atoms with alcohols, e.g., methanol, ethanol, etc., polyols and polyol ethers such as neopentyl glycol, trimethylol propane, pentaerythritol, dipentaerythritol, tripentaerythritol, and the like.

Silicon-based oils such as, for example, polyalkyl-, polyaryl-, polyalkoxy- or polyaryloxy-siloxane oils and silicate oils, comprise another useful class of synthetic lubricating oils. Specific examples of these include, but are not limited to, tetraethyl silicate, tetra-isopropyl silicate, tetra-(2-ethylhexyl) silicate, tetra-(4-methyl-hexyl)silicate, tetra-(p-tert-butylphenyl)silicate, hexyl-(4-methyl-2-pentoxy)disiloxane, poly(methyl)siloxanes, poly(methylphenyl)siloxanes, and the like. Still yet other useful synthetic lubricating oils include, but are not limited to, liquid esters of phosphorous containing acids, e.g., tricresyl phosphate, trioctyl phosphate, diethyl ester of decane phosphionic acid, etc., polymeric tetrahydrofurans and the like.

The lubricating oil may be derived from unrefined, refined and rerefined oils, either natural, synthetic or mixtures of two or more of any of these of the type disclosed hereinabove. Unrefined oils are those obtained directly from a natural or synthetic source (e.g., coal, shale, or tar sands bitumen) without further purification or treatment. Examples of unrefined oils include, but are not limited to, a shale oil obtained directly from retorting operations, a petroleum oil obtained directly from distillation or an ester oil obtained directly from an esterification process, each of which is then used without further treatment. Refined oils are similar to the unrefined oils except they have been further treated in one or more purification steps to improve one or more properties. These purification techniques are known to those of skill in the art and include, for example, solvent extractions, secondary distillation, acid or base extraction, filtration, percolation, hydrotreating, dewaxing, etc. Rerefined oils are obtained by treating used oils in processes similar to those used to obtain refined oils. Such rerefined oils are also known as reclaimed or reprocessed oils and often are additionally processed by techniques directed to removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst.

Natural waxes are typically the slack waxes recovered by the solvent dewaxing of mineral oils; synthetic waxes are typically the wax produced by the Fischer-Tropsch process.

Generally, the reaction products for incorporating into the foregoing base oils are obtained from the reaction of at least one first polyol ester and at least one second polyol ester. Preferably, the reaction product is obtained from the transesterification (i.e., the exchange of an acyl group of one ester with that of another ester) of at least one glycerol ester and at least one non-glycerol polyol ester. Transesterification of two polyol esters randomizes the distribution of fatty acids among the polyol backbones, resulting in the transesterified products having properties different from each of the original polyol esters. Representative of the reaction products and their preparation are known in the art, e.g., in U.S. Pat. No. 6,278,006, the contents of which are incorporated by reference herein.

The at least one glycerol ester is ordinarily a $C_4$ to about $C_{75}$ fatty acid glycerol ester and preferably about $C_6$ to about $C_{24}$ fatty acid glycerol ester. The glycerol esters for use in forming the reaction product herein are glycerides derived from, for example, natural sources, i.e., those derived from natural sources such as plants or animals; synthetic oils and the like and combinations thereof. Useful natural oil include, but are not limited to, coconut oil, babassu oil, palm kernel oil, palm oil, olive oil, castor oil, rape oil, corn oil, beef tallow oil, whale oil, sunflower, cottonseed oil, linseed oil, tung oil, tallow oil, lard oil, peanut oil, canola oil, soya oil, and the like. Synthetic oils for use herein refers to products produced by reacting carboxylic acids with glycerol, e.g., glycerol triacetate, and the like. Suitable starting oils will ordinarily contain triacylglycerols (TAGs), which contain three fatty acid chains esterified to a glycerol moiety and can be natural or synthetic. For example, TAGs such as triolein, trieicosenoin, or trierucin can be used as starting materials. TAGs are commercially available, for example, from Sigma Chemical Company (St. Louis, Mo.), or can be synthesized using standard techniques. such as, for example, beef tallow oil, lard oil, palm oil, castor oil, cottonseed oil, corn oil, peanut oil, soybean oil, sunflower oil, olive oil, whale oil, menhaden oil, sardine oil, coconut oil, palm kernel oil, babassu oil, rape oil, canola oil, soya oil and the like with canola oil being preferred for use herein.

The foregoing glycerol esters will contain from about $C_4$ to about $C_{75}$ and preferably contain about $C_6$ to about $C_{24}$ fatty acid esters, i.e., several fatty acid moieties, the number and type varying with the source of the oil. Fatty acids are a class of compounds containing a long hydrocarbon chain and a terminal carboxylate group and are characterized as unsaturated or saturated depending upon whether a double bond is present in the hydrocarbon chain. Therefore, an unsaturated fatty acid has at least one double bond in its hydrocarbon chain whereas a saturated fatty acid has no double bonds in its fatty acid chain. Examples of unsaturated fatty acids include, myristoleic acid, palmitoleic acid, oleic acid, linolenic acid, and the like. Examples of saturated fatty acids include caproic acid, caprylic acid, capric acid, lauric acid, myristic acid, palmitic acid, stearic acid, arachidic acid, behenic acid, lignoceric acid, and the like.

The acid moiety may be supplied in a fully esterfied compound or one which is less than fully esterfied, e.g., glyceryl tri-stearate, or glyceryl di-laurate and glyceryl mono-oleate, respectively. It is particularly advantageous to employ plant derived oils, i.e., vegetable oils, as starting materials, as they allow the reaction products herein to be produced in a cost-effective manner. Suitable vegetable oils have a monounsaturated fatty acid content of at least about 50%, based on total fatty acid content, and include, for example, rapeseed (*Brassica*), sunflower (*Helianthus*), soybean (*Glycine max*), corn (*Zea mays*), crambe (*Crambe*), and meadowfoam (*Limnanthes*) oil. Canola oil, which has less than 2% erucic acid, is a particularly useful rapeseed oil. Oils having a monounsaturated fatty acid content of at least 70% are also particularly useful. The monounsaturated fatty acid content can be composed of, for example, oleic acid ($C_{18:1}$), eicosenoic acid ($C_{20:1}$), erucic acid ($C_{22:1}$), or combinations thereof.

In general, the foregoing glycerol esters can possess the general formula:

(I)

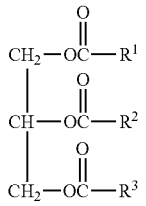

wherein $R^1$, $R^2$ and $R^3$ are independently aliphatic hydrocarbyl moieties having 4 to about 75 carbon atoms, preferably 4 to about 24 carbon atoms inclusive, and most preferably wherein at least one of $R^1$, $R^2$ and $R^3$ have a saturated aliphatic hydrocarbyl moiety having 4 to 10 carbon atoms inclusive and wherein at least one of $R^1$, $R^2$ and $R^3$ have an aliphatic hydrocarbyl moiety having from 11 to 24 carbon atoms inclusive.

Generally, non-glycerol polyol esters can be used in the transesterification of the foregoing glycerol fatty acid esters. As used herein, "non-glycerol polyol esters" refers to esters produced from polyols containing from two to about 10 carbon atoms and from two to six hydroxyl groups. Preferably, the polyols contain two to four hydroxyl moieties. Non-limiting examples include, but are not limited to, 1,2-propanediol, 1,3-propanediol, 1,2-butanediol, 1,3-butanediol, 2,3-butanediol, 2-ethyl-1,3-propanediol, 2-ethyl-2-butyl-1,3-propanediol, neopentyl glycol, 2,2,4-trimethyl-1,3-pentanediol, trimethylolpropane (TMP), pentaerythritol and the like and combinations thereof. Neopentyl glycol, TMP, and pentaerythritol are particularly useful polyols. The polyol esters can be produced by, for example, transesterification of a polyol with methyl esters of short chain fatty acids. As used herein, "short chain fatty acid" refers to all isomers of saturated fatty acids having chains of four to ten carbons, including fatty acids containing odd or even numbers of carbon atoms. Short chain fatty acids can include alkyl groups. For example, 2-ethyl hexanoic acid is a useful short chain fatty acid. Short chain fatty acids includes, for example, isomers of saturated fatty acids having chains of four to ten carbons including fatty acids containing odd or even numbers of carbon atoms and can include alkyl groups, e.g., 2-ethyl hexanoic acid.

Preferably, the second non-glycerol polyol esters are of the general formula:

(II)

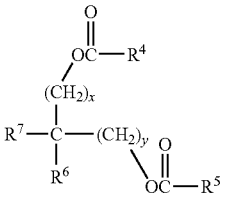

wherein x and y are the same or different and are integers from 1 to 6 and most preferably 1, $R^4$ and $R^5$ are independently aliphatic hydrocarbyl moieties having 4 to 24 carbon atoms and preferably wherein at least one of $R^4$ and $R^5$ have a saturated aliphatic hydrocarbyl moiety, and wherein at least one of $R^4$ and $R^5$ have an aliphatic hydrocarbyl moiety having from 11 to 24 carbon atoms and $R^6$ and $R^7$ are independently hydrogen, an aliphatic hydrocarbyl moiety having 1 to 10 carbon atoms or

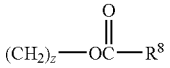

wherein z is an integer from 0 to 6 and $R^8$ is an aliphatic hydrocarbyl moiety having 4 to 24 carbon atoms. Most preferred polyol esters for use herein are TMP esters such as, for example, TMP tri(2-ethyl hexanoate), TMP triheptanoate (TMPTH), TMP tricaprylate, TMP tricaprate, TMP tri-oleate, TMP tri(isononanoate) and the like and combinations thereof.

In general, transesterification can be carried out by adding the glycerol fatty acid esters (e.g., the compound(s) of formula (I)), e.g., a vegetable oil, to the non-glycerol polyol esters (e.g., the compound(s) of formula (II)) in the presence of a suitable catalyst and heating the mixture. Typically, the glycerol fatty acid esters comprises about 5% to about 90% of the reaction mixture by weight. For example, adding the glycerol fatty acid esters such as vegetable oil, e.g., canola oil, can be about 10% to about 90%, preferably about 40% to about 90%, and more preferably about 60% to about 90% of the mixture. The non-glycerol polyol esters can be about 10% to about 50% of the reaction mixture by weight, and preferably about 15% to about 30% of the reaction mixture. For example, the short chain fatty acid esters can be about 20% to about 25% of the reaction mixture. Ratios of vegetable oil: short chain fatty acid ester of about 80:20 or about 75:25 yield a high number of TAGs containing a single short chain, and also modify a majority of the TAGs in the vegetable oil.

Suitable catalysts for use in the transesterification include, but are not limited to, base catalysts, sodium methoxide, acid catalysts including inorganic acids such as sulfuric acid and acidified clays, organic acids such as methane sulfonic acid, benzenesulfonic acid, and toluenesulfonic acid, and acidic resins such as Amberlyst 15. Metals such as sodium and magnesium, and metal hydrides also are useful catalysts. Progress of the reaction can be monitored using standard techniques such as high performance liquid chromatography (HPLC), infrared spectrometry, thin layer chromatography (TLC), Raman spectroscopy, or UV absorption. Upon completion of the reaction, sodium methoxide catalyst can be neutralized, for example, by addition of water or aqueous ammonium chloride. Acid catalysts can be neutralized by a base such as a sodium bicarbonate solution. Deactivated catalyst and soaps can be removed by a water wash, followed by centrifugation. The oil can be dried by addition of anhydrous magnesium sulfate or sodium sulfate. Any remaining water can be removed by heating to about 60° C. under vacuum. Alkyl esters can be removed by distillation.

In general, the foregoing reaction products can be used singly or in combination of two or more reaction products in base oils to provide deposit protection as well as good wear and oxidation-corrosion protection. To provide such protection in lubricating oil compositions such as, for example, low phosphorous or phosphorous-free and/or low phosphorous or phosphorous-free and low sulfur or sulfur free lubricating oil compositions, the foregoing reaction products are generally incorporated into base oils in a minor deposit-inhibiting effective amount to give a compounded engine oil, e.g., an amount ranging from about 0.05 to about 10 wt. %, preferably from about 0.1 to about 8 wt %, most preferably from about 0.2 to about 5 wt % and more preferably from about 1 to about 5 wt. %, based on the total weight of the composition. The expression "minor deposit-inhibiting effective amount" as used herein shall be understood to mean an amount effective to prevent or inhibit formation of deposits associated with internal combustion engines such as, for example, fuel combustion deposits, high temperature piston deposits, etc.

By using the foregoing reaction products in combination with very low levels of phosphorous-containing antiwear additives such as, for example, zinc dialkyldithiophosphate and tricresylphosphite, and low levels of sulfur-containing additives; excellent results can be obtained in terms of both engine protection and environmental low phosphorous consideration. It is advantageous to use the reaction product such that the phosphorous content of the compounded engine oil is less than 0.1 wt. %, preferably no higher than 0.08 wt. %, and more preferably no higher than 0.05 wt. % and the sulfur content of the compounded engine oil is no higher than 0.2 wt. %, to provide the desired levels of antiwear properties, oxidation inhibition and deposit control. (It should perhaps be noted that because of the phosphorus catalyst poisoning problem, with the exception of zinc dialkyldithiophosphate, phosphorus-containing compounds are avoided in such engine oils, particularly those intended for use in automotive engines. Thus, in the case of the present invention, phosphorus and sulfur content is calculated based on the zinc dialkyldithiophosphate and its molecular phosphorus content, and directly equates to zinc dialkyldithiophosphate content.) The sulfur content derives from zinc dialkyldithiophosphate, sulfonate and phenate detergents, diluent oil and base oil. Also, the sulfur content in the lubricating oil composition can be measured by conventional techniques, for example, x-ray techniques.

Zinc dialkyldithiophosphates are, of course, known wear inhibiting agents and can be obtained from commercial sources or, if desired, prepared by known procedures. As is well known, zinc dialkyldithiophosphates refer to a class of compounds generally having the formula

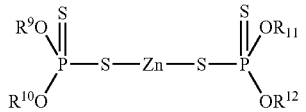

wherein $R^9$, $R^{10}$, $R^{11}$ and $R^{12}$ are independently alkyl or alkylphenyl. Typically the alkyl group has about from 1 to 20 carbon atoms, preferably 3 to 10 carbon atoms, and can be straight chained or branched. A variety of zinc dialkyldithiophosphates are, for example, described in an article by Born et al. entitled "Relationship between Chemical Structure and Effectiveness of Some Metallic Dialkyl- and Diaryl-dithiophosphates in Different Lubricated Mechanisms", appearing in Lubrication Science 4-2 January 1992, see for example pages 97-100.

Preferably, the lubricating oil compositions of the present invention will contain other conventional additives for imparting auxiliary functions to give a finished lubricating oil composition in which these additives are dispersed or dissolved. For example, the lubricating oil compositions can be blended with metal detergents, rust inhibitors, dehazers, demulsifiers, metal deactivators, friction modifiers, viscosity index improvers, pour point depressants, antifoaming agents, co-solvents, package compatibilisers, deodorants and metallic-based additives such as metallic combustion improvers, anti-knock compounds, anti-icing additives, corrosion-inhibitors, ashless dispersants, dyes, and the like. A variety of the additives are known and commercially available. These additives, or their analogous compounds, can be employed for the preparation of the engine oils of the invention by the usual blending procedures.

Examples of the ashless dispersants which may be used in the present engine oil are alkyl or alkenyl substituted succinimides, succinic esters and benzylamines, in which the alkyl or alkenyl group has a molecular weight of approximately 700-3,000. The derivatives of these dispersants, e.g., borated dispersants such as borated succinimides incorporated to assist with wear and deposit control, may also be used. The ashless dispersant is generally incorporated into an engine oil in an amount of 0.5-15 wt. % per total amount of the engine oil.

Examples of the viscosity index improvers are poly-(alkyl methacrylate), ethylene-propylene copolymer, polyisoprene, and styrene-butadiene copolymer. Viscosity index improvers of dispersant type (having increased dispersancy) or multifunctional type are also employed. These viscosity index improvers can be used singly or in combination. The amount of viscosity index improver to be incorporated into the engine oil varies with viscosity requirements of the engine oil, but generally in the range of about 0.5 to 20% by weight of the total weight of the engine oil lubricating composition. However, in the case of a monograde oil, no viscosity index improver is typically used.

Detergents for use herein may be overbased or neutral. For example, common detergents are sulfonates, e.g., those made from alkyl benzene and fuming sulfonic acid. Other suitable detergents for use herein include, but are not limited to, phenates (high overbased or low overbased), high overbased phenate stearates, phenolates, salicylates, phosphonates, thiophosphonates, ionic surfactants and sulfonates and the like with sulfonates being preferred and with low overbased metal sulfonates and neutral metal sulfonates being most preferred. Low overbased metal sulfonates typically have a total base number (TBN) of from about 0 to about 30 and preferably from about 10 to about 25. Low overbased metal sulfonates and neutral metal sulfonates are well known in the art.

The low overbased or neutral metal sulfonate detergent is preferably a low overbased or neutral alkali or alkaline earth metal salt of a hydrocarbyl sulfonic acid having from about 15 to about 200 carbon atoms. The term "metal sulfonate" as used herein is intended to encompass at least the salts of sulfonic acids derived from petroleum products. Such acids are well known in the art and can be obtained by, for example, treating petroleum products with sulfuric acid or sulfur trioxide. The acids obtained therefrom are known as petroleum sulfonic acids and the salts as petroleum sulfonates. Most of the petroleum product which become sulfonated contain an oil-solubilizing hydrocarbon group. Also, the meaning of "metal sulfonate" is intended to encompass the salts of sulfonic acids of synthetic alkyl, alkenyl and alkyl aryl compounds. These acids also are prepared by treating an alkyl, alkenyl or alkyl aryl compound with sulfuric acid or sulfur trioxide with at least one alkyl substituent of the aryl ring being an oil-solubilizing group. The acids obtained therefrom are known as alkyl sulfonic acids, alkenyl sulfonic acids or alkyl aryl sulfonic acids and the salts as alkyl sulfonates, alkenyl sulfonates or alkyl aryl sulfonates.

The acids obtained by sulfonation are converted to metal salts by neutralization with one or more basic reacting alkali or alkaline earth metal compounds to yield Group IA or Group IIA metal sulfonates. Generally, the acids are neutralized with an alkali metal base. Alkaline earth metal salts are obtained from the alkali metal salt by metathesis. Alternatively, the sulfonic acids can be neutralized directly with an alkaline earth metal base. If desired, the sulfonates can then be overbased to produce the low overbased metal sulfonate. The metal compounds useful in making the basic metal salts are generally any Group IA or Group IIA metal compounds (CAS version of the Periodic Table of the Elements). The Group IA metals of the metal compound include alkali metals, e.g., sodium, potassium, lithium. The Group IIA metals of the metal base include the alkaline earth metals such, for example, magnesium, calcium, barium, etc. Preferably the metal compound for use herein is calcium. The metal compounds are ordinarily delivered as metal salts. The anionic portion of the salt can be hydroxyl, oxide, carbonate, borate, nitrate, etc.

The sulfonic acids useful in making the low overbased or neutral salts include the sulfonic and thiosulfonic acids. Generally they are salts of sulfonic acids. The sulfonic acids include, for example, the mono- or polynuclear aromatic or cycloaliphatic compounds. The oil-soluble sulfonates can be represented for the most part by one of the following formulae: $R_2$—T—$(SO_3)_a$ and $R_3$—$(SO_3)_b$, wherein T is a cyclic nucleus such as, for example, benzene, naphthalene, anthracene, diphenylene oxide, diphenylene sulfide, petroleum naphthenes, etc.; $R_2$ is an aliphatic group such as alkyl, alkenyl, alkoxy, alkoxyalkyl, etc.; $(R_2)$+T contains a total of at least about 15 carbon atoms; and $R_3$ is an aliphatic hydrocarbyl group containing at least about 15 carbon atoms. Examples of $R_3$ are alkyl, alkenyl, alkoxyalkyl, carboalkoxyalkyl, etc. Specific examples of $R_3$ are groups derived from petrolatum, saturated and unsaturated paraffin wax, and the above-described polyalkenes. The groups T, $R_2$, and $R_3$ in the above Formulae can also contain other inorganic or organic substituents in addition to those enumerated above such as, for example, hydroxy, mercapto, halogen, nitro, amino, nitroso, sulfide, disulfide, etc. In the above Formulae, a and b are at least 1. In one embodiment, the sulfonic acids have a substituent ($R_2$ or $R_3$) which is derived from one of the above-described polyalkenes.

Illustrative examples of these sulfonic acids include monoeicosanyl-substituted naphthalene sulfonic acids, dodecylbenzene sulfonic acids, didodecylbenzene sulfonic acids, dinonylbenzene sulfonic acids, cetylchlorobenzene sulfonic acids, dilauryl beta-naphthalene sulfonic acids, the sulfonic acid derived by the treatment of polybutene having a number average molecular weight ($M_n$) in the range of about 350 to about 5000, preferably about 800 to about 2000, or about 1500 with chlorosulfonic acid, nitronaphthalene sulfonic acid, paraffin wax sulfonic acid, cetylcyclopentane, sulfonic acid, lauryl-cyclohexane sulfonic acids, polyethylenyl-substituted sulfonic acids derived from polyethylene ($M_n$ of from about 300 to about 1000, and preferably about 750), etc. Normally the aliphatic groups will be alkyl and/or alkenyl groups such that the total number of aliphatic carbons is at least about 8, preferably at least 12 up to about 400 carbon atoms, preferably about 250. Also useful are polyisobutene sulfonates, e.g., those disclosed in U.S. Pat. No. 6,410,491, the contents of which are incorporated by reference herein.

Another group of sulfonic acids are mono-, di-, and tri-alkylated benzene and naphthalene (including hydrogenated forms thereof) sulfonic acids. Illustrative of synthetically produced alkylated benzene and naphthalene sulfonic acids are those containing alkyl substituents having from about 8 to about 30 carbon atoms, preferably about 12 to about 30 carbon atoms, and advantageously about 24 carbon atoms. Such acids include di-isododecylbenzene sulfonic acid, polybutenyl-substituted sulfonic acid, polypropylenyl-substituted sulfonic acids derived from polypropene having an $M_n$ of from about 300 to about 1000 and preferably from about 500 to about 700, cetylchlorobenzene sulfonic acid, di-cetylnaphthalene sulfonic acid, di-lauryldiphenylether sulfonic acid, diisononylbenzene sulfonic acid, di-isooctadecylbenzene sulfonic acid, stearylnaphthalene sulfonic acid, and the like.

Specific examples of oil-soluble sulfonic acids are mahogany sulfonic acids; bright stock sulfonic acids; sulfonic acids derived from lubricating oil fractions having a Saybolt viscosity from about 100 seconds at 100° F. to about 200 seconds at 210° F.; petrolatum sulfonic acids; mono- and poly-wax-substituted sulfonic and polysulfonic acids of, e.g., benzene, naphthalene, phenol, diphenyl ether, naphthalene disulfide, etc.; other substituted sulfonic acids such as alkyl benzene sulfonic acids (where the alkyl group has at least 8 carbons), cetylphenol mono-sulfide sulfonic acids, dilauryl beta naphthyl sulfonic acids, and alkaryl sulfonic acids such as dodecyl benzene "bottoms" sulfonic acids.

Dodecyl benzene "bottoms" sulfonic acids are the material leftover after the removal of dodecyl benzene sulfonic acids that are used for household detergents. These materials are generally alkylated with higher oligomers. The bottoms may be straight-chain or branched-chain alkylates with a straight-chain dialkylate preferred.

Particularly preferred based on their wide availability are salts of the petroleum sulfonic acid, e.g., those obtained by sulfonating various hydrocarbon fractions such as lubricating oil fraction and extracts rich in aromatics which are obtained by extracting a hydrocarbon oil with a selective solvent, which extract may, if desired, be alkylated before sulfonation by reacting them with olefins or alkyl chlorides by means of an alkylation catalyst; organic polysulfonic acids such as benzene disulfonic acid which may or may not be alkylated; and the like.

Other particularly preferred salts for use herein are alkylated aromatic sulfonic acids in which the alkyl radical or radicals contain at least about 6 carbon atoms and preferably from about 8 to about 22 carbon atoms. Another preferred group of sulfonate starting materials are the aliphatic-substituted cyclic sulfonic acids in which the aliphatic substituent or substituents contain a total of at least 12 carbon atoms such as, for example, alkyl aryl sulfonic acids, alkyl cycloaliphatic sulfonic acids, the alkyl heterocyclic sulfonic acids and aliphatic sulfonic acids in which the aliphatic radical or radicals contain a total of at least 12 carbon atoms. Specific examples of these oil-soluble sulfonic acids include, but are not limited to, petroleum sulfonic acids; petrolatum sulfonic acids; mono- and poly-wax-substituted naphthalene sulfonic acids; substituted sulfonic acids such as cetyl benzene sulfonic acids, cetyl phenyl sulfonic acids and the like; aliphatic sulfonic acids such as paraffin wax sulfonic acids, hydroxy-substituted paraffin wax sulfonic acids and the like; cycloaliphatic sulfonic acids; petroleum naphthalene sulfonic acids; cyclopentyl sulfonic acid; mono- and poly-wax-substituted cyclohexyl sulfonic acids and the like. The expression "petroleum sulfonic acids" as used herein shall be understood to cover all sulfonic acids that are derived directly from petroleum products.

Typical Group IIA metal sulfonates suitable for use herein include, but are not limited to, the metal sulfonates exemplified as follows: calcium white oil benzene sulfonate, barium white oil benzene sulfonate, calcium dipropylene benzene sulfonate, barium dipropylene benzene sulfonate, calcium mahogany petroleum sulfonate, barium mahogany petroleum sulfonate, calcium triacontyl sulfonate, calcium lauryl sulfonate, barium lauryl sulfonate, and the like.

The acidic material used to accomplish the formation of the overbased metal salt can be a liquid such as, for example, formic acid, acetic acid, nitric acid, sulfuric acid, etc, or an inorganic acidic material such as, for example, HCl, $SO_2$, $SO_3$, $CO_2$, $H_2S$, etc, with $CO_2$ being preferred. The amount of acidic material used depends in some respects upon the desired basicity of the product in question and also upon the amount of basic metal compound employed which will vary (in total amount) from about 1 to about 10, preferably from about 1.2 to about 8 and most preferably from about 1.7 to about 6.0 equivalents per equivalent of acid. In the case of an acidic gas, the acidic gas is generally blown below the surface of the reaction mixture that contains additional (i.e., amounts in excess of what is required to convert the acid quantitatively to the metal salt) base. The acidic material employed during this step is used to react with the excess basic metal compound which may be already present or which can be added during this step.

The reaction medium used to prepare the low overbased metal sulfonate or neutral metal sulfonate is typically an inert solvent. Suitable inert solvents that can be employed herein include oils, organic materials which are readily soluble or miscible with oil and the like. Suitable oils include high boiling, high molecular weight oils such as, for example, parrafinic oils having boiling points higher than about 170° C. Commercially available oils of this type known to one skilled in the art include, e.g., those available from such sources as Exxon under the Isopar® tradenames, e.g., Isopar® M, Isopar® G, Isopar® H, and Isopar® V, and the Telura® tradename, e.g., Telura® 407, and Crompton Corporation available as carnation oil. Suitable organic solvents include unsubstituted or substituted aromatic hydrocarbons, ethoxylated long chain alcohols, e.g., those ethoxylated alcohols having up to about 20 carbon atoms, and mixtures thereof. Useful unsubstituted or substituted aromatic hydrocarbons include high flash solvent naptha and the like.

If desired, a promoter can also be employed in preparing the low overbased metal sulfonate or neutral metal sulfonate. A promoter is a chemical employed to facilitate the incorporation of metal into the basic metal compositions. Among the chemicals useful as promoters are, for example, water, ammonium hydroxide, organic acids of up to about 8 carbon atoms, nitric acid, sulfuric acid, hydrochloric acid, metal complexing agents such as alkyl salicylaldoxime, and alkali metal hydroxides such as lithium hydroxide, sodium hydroxide and potassium hydroxide, and mono- and polyhydric alcohols of up to about 30 carbon atoms. Examples of the alcohols include methanol, ethanol, isopropanol, dodecanol, behenyl alcohol, ethylene glycol, monomethylether of ethylene glycol, hexamethylene glycol, glycerol, pentaerythritol, benzyl alcohol, phenylethyl alcohol, aminoethanol, cinnamyl alcohol, allyl alcohol, and the like. Especially useful are the monohydric alcohols having up to about 10 carbon atoms and mixtures of methanol with higher monohydric alcohols. Amounts of promoter will ordinarily range from about 0% to about 25%, preferably from about 1.5% to about 20% and most preferably from about 2% to about 16% of acid charge. The predominant detergent metal is calcium but sodium, magnesium, and barium have been used in practice. The amount of detergent to be incorporated into the engine oil varies widely, but effective concentrations generally range from about 0.2 to about 10% by weight of the total weight of the engine oil lubricating composition.

Antioxidants are advantageously used in engine oils to forestall oxidative degradation of the lubricant. Besides zinc dialkyldithiophosphates, antioxidants include, but are not limited to, aminic types (e.g., diphenylamine or phenyl-alpha-napthyl-amine), phenolics (e.g., BHT), sulfur-containing materials (sulfurized olefins or esters) and the like. These supplemental antioxidants are typically used at a total tract rate of 0.1 to 2 wt. % of the finished fluid.

Examples of supplemental antiwear agents are usually non-phosphorus compounds added to a lubricant to fortify wear protection. These materials frequently contain sulfur, usually as sulfide. Common examples include carbamates (ashless or not), xanthates, and alky sulfides or polysulfides. Because of the high sulfur content, these materials are often potent antioxidants.

As well as the above additives, the lubricating oil composition may contain various other additives such as, for example, other oxidation-corrosion inhibitors such as hindered phenols and other antiwear agents can be used in combination with the foregoing reaction products.

Each of the foregoing additives, when used, is used at a functionally effective amount to impart the desired properties to the lubricant. Thus, for example, if an additive is a friction modifier, a functionally effective amount of this friction modifier would be an amount sufficient to impart the desired friction modifying characteristics to the lubricant. Generally, the concentration of each of these additives, when used, ranges from about 0.001% to about 20% by weight, and in one embodiment about 0.01% to about 10% by weight based on the total weight of the low phosphorous lubricating oil composition and low phosphorous and low sulfur lubricating oil composition.

In another embodiment of the invention, the foregoing reaction products may be provided as an additive package or concentrate which will be incorporated into a substantially inert, normally liquid organic diluent such as, for example, mineral oil, naphtha, benzene, toluene or xylene to form an additive concentrate. These concentrates usually contain from about 1% to about 99% by weight, and in one embodiment about 10% to about 90% by weight of such diluent. Typically, a neutral oil having a viscosity of about 4 to about 8.5 cSt at 100° C. and preferably about 4 to about 6 cSt at 100° C. will be used as the diluent, though synthetic oils, as well as other organic liquids which are compatible with the additives and finished lubricating oil can also be used. The additive package will also typically contain one or more of the various other additives, referred to above, in the desired amounts and ratios to facilitate direct combination with the requisite amount of base oil.

Preferably, the additive concentrate comprises a metal-containing detergent, an ashless dispersant, the foregoing reactions, zinc dialkyldithiophosphate and optional components dissolved or dispersed in an organic liquid diluent, at a high concentration.

The following non-limiting examples are illustrative of the present invention.

EXAMPLES

The following examples provide lubricating oil compositions which were formulated to give viscosity conditions of a SAE 5W30 oil defined in the Society of Automotive Engineers classification system SAE J300.

Comparative Example A

A lubricating oil composition was formed by adding to a mixture of 78.1 wt. % of CHEVRON 100N (a Group II base oil) commercially available from ChevronTexaco Corp. (San Ramon, Calif.) and 21.9 wt. % of CHEVRON 220N (a Group II base oil) commercially available from ChevronTexaco Corp. (San Ramon, Calif.), an additive package containing the following additives (each of the components contain diluent oil to facilitate handling such that both the diluent oil and component are included in the component weight):

Additive Package

Ashless dispersant—An ashless succinimide was the primary dispersant and was prepared from 2300 molecular weight polyisobutylene, succinic anhydride, and a polyethylene amine. The resultant product is post-treated with ethylene carbonate. The post-treated succinimide dispersant was used in the lubricating oil composition at 2.34 wt. %.

Borated succinimide auxiliary dispersant—The auxiliary dispersant was a boron-containing succinimide prepared from polyisobutylene, succinic anhydride, and a polyethylene amine. The resultant product was post-treated with boric acid. The borated succinimide dispersant was used in the lubricating oil composition at 1.44 wt. %.

Overbased calcium phenate detergent—The overbased phenate detergent was prepared from a di (alkylated phenol) sulfide. The phenol group was neutralized and then the resultant salt was overbased with lime and carbon dioxide. The resultant Total Base Number (TBN) of this component was about 250. The overbased phenate was used in the lubricating oil composition at approximately 2.14 wt. %.

Secondary zinc dialkyldithiophosphate (ZnDTP)—The secondary ZnDTP was prepared from phosphorus pentasulfide and a mixture of secondary alcohols. The resultant mixture was neutralized with zinc oxide to produce ZnDTP. The secondary ZnDTP was used in the lubricating oil composition at 1.14 wt. %.

Alkylated diphenylamine ashless antioxidant—The ashless amine antioxidant was a di-alkylated, di-phenyl amine. This material was particularly effective for high temperature oxidation control in internal combustion engines. The ashless antioxidant was used in the lubricating oil composition at 0.27 wt. %.

Molybdenum-containing antioxidant—The molybdenum-containing antioxidant was used in the lubricating oil composition at 0.117 wt. %.

Friction modifier—The friction modifier was based upon glycerol mono-oleate that has been treated with boric acid to make a borate ester. The friction modifier was used in the lubricating oil composition at 0.18 wt. %.

Silicon-based foam inhibitor—The foam inhibitor was a commercially-available 12,500 molecular weight silicon oil diluted 1 to 49 parts in a light neutral solvent. The foam inhibitor was used in the lubricating oil composition at 4.5 ppm.

Viscosity modifier—The viscosity modifier was a moderately shear stable olefin copolymer. The viscosity improver was used in the lubricating oil composition at 10.1 wt. %.

The lubricating oil composition of Comparative Example A possessed a phosphorous content of approximately 0.08 wt. % and a sulfur content of approximately 0.2 wt. %.

Example 1

A lubricating oil composition was formed by adding to a mixture of 78 wt. % of CHEVRON 100N (a Group II base oil) commercially available from ChevronTexaco Corp. (San Ramon, Calif.), 21.9 wt. % of CHEVRON 220N (a Group II base oil) commercially available from ChevronTexaco Corp. (San Ramon, Calif.) and 0.1 wt. % of Cargill AP560 (transesterified product of canola oil and TMP triheptanoate) available from Cargill, Incorporated (Wayzata, Minn.), the additive package of Comparative Example A. The lubricating oil composition possessed a phosphorous content of 0.08 wt. % and a sulfur content of 0.2 wt. %.

Example 2

A lubricating oil composition was formed by adding to a mixture of 78.2 wt. % of CHEVRON 100N (a Group II base oil) commercially available from ChevronTexaco Corp. (San Ramon, Calif.), 21.4 wt. % of CHEVRON 220N (a Group II base oil) commercially available from ChevronTexaco Corp. (San Ramon, Calif.) and 0.4 wt. % of Cargill AP560 (transesterified product of canola oil and TMP triheptanoate) available from Cargill, Incorporated (Wayzata, Minn.), the additive package of Comparative Example A. The lubricating oil composition possessed a phosphorous content of 0.08 wt. % and a sulfur content of 0.2 wt. %.

Example 3

A lubricating oil composition was formed by adding to a mixture of 78.2 wt. % of CHEVRON 100N (a Group II base oil) commercially available from ChevronTexaco Corp. (San Ramon, Calif.), 21.1 wt. % of CHEVRON 220N (a Group II base oil) commercially available from ChevronTexaco Corp. (San Ramon, Calif.) and 0.7 wt. % of Cargill AP560 (transesterified product of canola oil and TMP triheptanoate) available from Cargill, Incorporated (Wayzata, Minn.), the additive package of Comparative Example A. The lubricating oil composition possessed a phosphorous content of 0.08 wt. % and a sulfur content of 0.2 wt. %.

Example 4

A lubricating oil composition was formed by adding to a mixture of 78.2 wt. % of CHEVRON 100N (a Group II base oil) commercially available from ChevronTexaco Corp. (San Ramon, Calif.), 20.8 wt. % of CHEVRON 220N (a Group II base oil) commercially available from ChevronTexaco Corp. (San Ramon, Calif.) and 1 wt. % of Cargill AP560 (transesterified product of canola oil and TMP triheptanoate) available from Cargill, Incorporated (Wayzata, Minn.), the additive package of Comparative Example A. The lubricating oil composition possessed a phosphorous content of 0.08 wt. % and a sulfur content of 0.2 wt. %.

Example 5

A lubricating oil composition was formed by adding to a mixture of 74.2 wt. % of CHEVRON 100N (a Group II base oil) commercially available from ChevronTexaco Corp. (San Ramon, Calif.), 20.8 wt. % of CHEVRON 220N (a Group II base oil) commercially available from ChevronTexaco Corp. (San Ramon, Calif.) and 5 wt. % of Cargill AP560 (transesterified product of canola oil and TMP triheptanoate) available from Cargill, Incorporated (Wayzata, Minn.), the additive package of Comparative Example A. The lubricating oil composition possessed a phosphorous content of 0.08 wt. % and a sulfur content of 0.2 wt. %.

Example 6

A lubricating oil composition was formed by adding to a mixture of 70.3 wt. % of CHEVRON 100N (a Group II base oil) commercially available from ChevronTexaco Corp. (San Ramon, Calif.), 19.7 wt. % of CHEVRON 220N (a Group II base oil) commercially available from ChevronTexaco Corp. (San Ramon, Calif.) and 10 wt. % of Cargill AP560 (transesterified product of canola oil and TMP triheptanoate) available from Cargill, Incorporated (Wayzata, Minn.), the additive package of Comparative Example A. The lubricating oil composition possessed a phosphorous content of 0.08 wt. % and a sulfur content of 0.2 wt. %.

Comparative Example B

A lubricating oil composition was formed by adding to a mixture of 74.2 wt. % of CHEVRON 100N (a Group II base oil) commercially available from ChevronTexaco Corp. (San Ramon, Calif.), 20.8 wt. % of CHEVRON 220N (a Group II base oil) commercially available from ChevronTexaco Corp. (San Ramon, Calif.) and 5 wt. % of Lexolube® 3N-310 (trimethylolpropane tri caprylate/caprate) available from Inolex Chemical Company (Philadelphia, Pa.), the additive package of Comparative Example A. The lubricating oil composition possessed a phosphorous content of 0.08 wt. % and a sulfur content of 0.2 wt. %.

Comparative Example C

A lubricating oil composition was formed by adding to a mixture of 70.3 wt. % of CHEVRON 100N (a Group II base oil) commercially available from ChevronTexaco Corp. (San Ramon, Calif.), 19.7 wt. % of CHEVRON 220N (a Group II base oil) commercially available from ChevronTexaco Corp. (San Ramon, Calif.) and 10 wt. % of Lexolube® 3N-310 (trimethylolpropane tri caprylate/caprate) available from Inolex Chemical Company (Philadelphia, Pa.), the additive package of Comparative Example A. The lubricating oil composition possessed a phosphorous content of 0.08 wt. % and a sulfur content of 0.2 wt. %.

Comparative Example D

A lubricating oil composition was formed by adding to a mixture of 74.2 wt. % of CHEVRON 100N (a Group II base oil) commercially available from ChevronTexaco Corp. (San Ramon, Calif.), 20.8 wt. % of CHEVRON 220N (a Group II base oil) commercially available from ChevronTexaco Corp. (San Ramon, Calif.) and 5 wt. % of Lexolube® 2X-109 (ditridecyladipate) available from Inolex Chemical Company (Philadelphia, Pa.), the additive package of Comparative Example A. The lubricating oil composition possessed a phosphorous content of 0.08 wt. % and a sulfur content of 0.2 wt. %.

Comparative Example E

A lubricating oil composition was formed by adding to a mixture of 70.3 wt. % of CHEVRON 100N (a Group II base oil) commercially available from ChevronTexaco Corp. (San Ramon, Calif.), 19.7 wt. % of CHEVRON 220N (a Group II base oil) commercially available from ChevronTexaco Corp. (San Ramon, Calif.) and 10 wt. % of Lexolube® 2X-109 (ditridecyladipate) available from Inolex Chemical Company (Philadelphia, Pa.), the additive package of Comparative Example A. The lubricating oil composition possessed a phosphorous content of 0.08 wt. % and a sulfur content of 0.2 wt. %.

Comparative Example F

A lubricating oil composition was formed by adding to a mixture of 74.2 wt. % of CHEVRON 100N (a Group II base oil) commercially available from ChevronTexaco Corp. (San Ramon, Calif.), 20.8 wt. % of CHEVRON 220N (a Group II base oil) commercially available from ChevronTexaco Corp. (San Ramon, Calif.) and 5 wt. % Lexolube® 4N-415 (pentaerythritol tetra caprylate/caprate) available from Inolex Chemical Company (Philadelphia, Pa.), the additive package of Comparative Example A. The lubricating oil composition possessed a phosphorous content of approximately 0.08 wt. % and a sulfur content of approximately 0.2 wt. %.

Comparative Example G

A lubricating oil composition was formed by adding to a mixture of 70.3 wt. % of CHEVRON 100N (a Group II base oil) commercially available from ChevronTexaco Corp. (San Ramon, Calif.), 19.7 wt. % of CHEVRON 220N (a Group II base oil) commercially available from ChevronTexaco Corp. (San Ramon, Calif.) and 10 wt. % of Lexolube® 4N-415 (pentaerythritol tetra caprylate/caprate) available from Inolex Chemical Company (Philadelphia, Pa.), the additive package of Comparative Example A. The lubricating oil composition possessed a phosphorous content of 0.08 wt. % and a sulfur content of 0.2 wt. %.

Testing

Each of the lubricating oil compositions of Examples 1 and 2 and Comparative Examples A-E were evaluated using the Thermo-Oxidation Engine Oil Simulation Test (TEOST) TEOST MHT-4 and TEOST 33 as described below.

TEOST MHT-4

The TEOST MHT-4 test as described in Florkowski et al., Draft 12 TEOST MHT-4 Test Method, to Henry Wheeler, Chair, ASTM D.02.07 TEOST Surveillance Panel Chair (Sep. 10, 1999) was performed to predict the moderately high temperature deposit forming tendencies of engine oil, especially in the piston ring belt area.

Using a TEOST apparatus available from Tannas Company (4800 James Savage Road, Midland, Mich. 48642), a sample of each of the lubricating engine oil compositions of Examples 1 and 2 and Comparative Examples A-E containing an organometallic catalyst was forced to flow past a tared, wire-wound depositor rod held in a glass mantled casing. The rod was resistively heated to obtain a constant temperature of 285° C. for 24 hours. During this time, dry air was forced to flow through the mantle chamber at a specified rate of 10 mL/min. At the end of the test, the depositor rod and the components of the chamber were carefully rinsed of oil residue using a volatile hydrocarbon solvent. After drying the rod, the mass of deposits was determined. The hydrocarbon solvent rinse was filtered and weighed and the mass of the accumulated filter deposits was determined. The mass of deposits on the rod plus the mass of deposits on the filter was the total deposit mass. The mass of deposits which have accumulated on the inside surface of the mantle were also weighed.

TEOST 33

The TEOST 33 test was performed to assess the deposit forming tendencies of engine oils brought into contact with 500° C. turbocharger components. The TEOST 33 test used herein is described in D. W. Florkowski and T. W. Selby, "The Development of a Thermo-Oxidation Engine Oil Simulation Test (TEOST), SAE Paper 932837 (1993) and Stipanovic et al., "Base Oil and Additive Effects in the Thermo-Oxidation Engine Oil Simulation Test (TEOST)," SAE Paper 962038 (1996).

The apparatus consisted of an oxidation reactor and a deposition zone made up of a hollow depositor rod axially aligned within an outer tube. The temperature of the reactor and the depositor rod were independently controlled. The lubricating oil composition under evaluation was mixed with 100 ppm of iron delivered as an iron naphthenate catalyst, then added to the reactor. The mixture was then heated to and held at 100° C. This sample was exposed to a gas stream of air, nitrous oxide, and water. Throughout the TEOST 33 test, the oil was pumped through the annulus between the depositor rod and the outside casing while the rod was cycled through a programmed temperature profile. Except for the initial temperature ramp from room temperature to 200° C., the temperature cycle was repeated 12 times. The total test duration was for a time period of 114 minutes.

At the completion of the oxidation cycle, the oil was collected and filtered. The equipment was cleaned with solvent and that solvent was also filtered. The filter used in collecting the oil was dried and weighed to determine the filter deposits. The depositor rod was dried and weighed to determine the accumulation of deposits. The total deposit was the sum of the rod and filter deposits and reported in milligrams. Test repeatability was originally given as +/−2.3 mg with a standard deviation of 1.6 mg.

The results of these tests are set forth below in Table 1.

TABLE 1

| Sample | TEOST MHT-4 (mg) | TEOST 33 (mg) |
|---|---|---|
| Example 1 | 50.6 | 56.9 |
| Example 2 | 47.6 | 48.9 |
| Example 3 | 51 | 48.6 |
| Example 4 | 33.5 | 36 |
| Example 5 | 28.5 | 20.6 |
| Example 6 | 35.1 | 18.8 |
| Comp. Ex. A | 45.2 | 57.3 |
| Comp. Ex. B | 36.3 | 39.7 |
| Comp. Ex. C | 39.7 | 34.7 |
| Comp. Ex. D | 47.3 | 82.2 |
| Comp. Ex. E | 49.4 | 105.4 |
| Comp. Ex. F | 40.3 | 36.2 |
| Comp. Ex. G | 46.5 | 36.4 |

The TEOST tests (TEOST 33 and TEOST MHT-4) are key bench tests for all ILSAC passenger car motor oil formulations. At present, only the TEOST MHT-4 test is required but the TEOST 33 test will likely be added back in the future. In order to pass the TEOST MHT-4 bench test, the lubricating oil can provide no higher than 40 mg, while for the TEOST 33 bench test, the lubricating oil composition can provide no higher than 60 mg. These tests behave differently to certain additives, namely, the TEOST MHT-4 test generally preferring ashless antioxidants like the diphenylamine and the TEOST 33 test generally preferring detergents. In general, the TEOST MHT-4 test results are ordinarily below the limit, while the TEOST 33 test results are typically borderline. Thus, to improve the TEOST 33 test results, low-overbased sulfonates, a potent detergent, are typically added to a formulation. This, however, increases sulfur content of the formulation.

Accordingly, and as the above data show, the lubricating oil compositions of Examples 4-6 using a reaction product of polyol esters within the scope of the present invention as a 1%, 5% and 10% by weight, respectively, replacement for the Group II mineral oils, provided a TEOST MHT-4 performance significantly better than that of the baseline formulation of Comparative Example A, i.e., 33.5 mg, 28.5 mg and 35.1 mg, respectively, as compared to 45.2 mg. The lubricating oil compositions of Examples 4-6 also performed significantly better than the lubricating oil composition of Comparative Example A in the TEOST 33 test, i.e., 36 mg, 20.6 mg and 18.8 mg, respectively, as compared to 57.3 mg. Clearly, by forming a lubricating oil composition containing the reaction product of the present invention, a significant improvement in the both the TEOST MHT-4 and TEOST 33 tests and deposit control is achieved.

Additionally, it can be seen that the lubricating oil compositions of Examples 1-3 using relatively low levels of a reaction product of polyol esters within the scope of the present invention provided substantially the same results for the TEOST MHT-4 test compared to the baseline formulation of Comparative Example A while providing slightly better results for the TEOST 33 test It is also noteworthy that the lubricating oil compositions of Examples 4-6 performed significantly better than the lubricating oil compositions of Comparative Examples B-G containing only a polyol ester. Accordingly, the lubricating oil compositions of Examples 4-6 provided better deposit control than the lubricating oil compositions of Comparative Examples B-G. These results are entirely unexpected.

It will be understood that various modifications may be made to the embodiments disclosed herein. Therefore the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed is:

1. A lubricating oil composition comprising (a) a major amount of a base oil of lubricating viscosity selected from the group consisting of Group II, III and IV basestocks, and mixtures thereof; and (b) about 0.05 to about 10 wt. %, based on the total weight of the composition, of a reaction product prepared by transesterifying at least one glycerol ester and at least one non-glycerol polyol ester, wherein the composition has a phosphorous content not exceeding 0.08 wt. % and a sulfur content not exceeding 0.2 wt. %, based on the total weight of the composition.

2. The lubricating oil composition of claim 1, wherein the glycerol ester is a mixed glycerol fatty acid ester.

3. The lubricating oil composition of claim 1, wherein the glycerol ester is a $C_4$ to about $C_{75}$ glycerol fatty acid ester.

4. The lubricating oil composition of claim 1, wherein the glycerol ester is a vegetable oil.

5. The lubricating oil composition of claim 4, wherein the vegetable oil is selected from the group consisting of corn oil, rapeseed oil, soybean oil, and sunflower oil.

6. The lubricating oil composition of claim 5, wherein the rapeseed oil is canola oil.

7. The lubricating oil composition of claim 1, wherein the non-glycerol polyol ester is a trimethylolpropane ester.

8. The lubricating oil composition of claim 1, wherein the non-glycerol polyol ester is trimethylolpropane triheptanoate.

9. The lubricating oil composition of claim 1, wherein the glycerol ester is a vegetable oil and the non-glycerol polyol ester is a trimethyloipropane ester.

10. The lubricating oil composition of claim 1, wherein the glycerol ester is canola oil and the non-glycerol polyol ester is trimethylolpropane triheptanoate.

11. The lubricating oil composition of claim 1, wherein the amount of the reaction product in the composition is about 0.1 to about 8 wt. %, based on the total weight of the composition.

12. The lubricating oil composition of claim 1, wherein the base oil of lubricating viscosity is comprised of a mineral base oil.

13. The lubricating oil composition of claim 1, wherein the base oil of lubricating viscosity is comprised of a polyalpha-olefin base oil.

14. The lubricating oil composition of claim 1 wherein the base oil of lubricating viscosity is comprised of a Group II basestock.

15. The lubricating oil composition of claim 1, wherein the reaction product is a reaction product of at least one glycerol ester of the general formula:

(I)

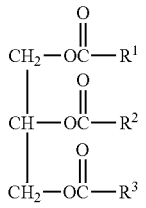

wherein $R^1$, $R^2$ and $R^3$ are independently aliphatic hydrocarbyl moieties having 4 to about 75 carbon atoms; and at least one non-glycerol ester of the general formula:

(II)

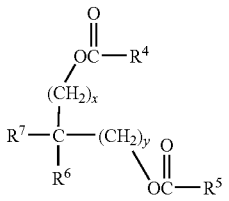

wherein x and y are the same or different and are integers from 1 to 6, $R^4$ and $R^5$ are independently aliphatic hydrocarbyl moieties having 4 to 24 carbon atoms and $R^6$ and $R^7$ are independently hydrogen, an aliphatic hydrocarbyl moiety having 1 to 10 carbon atoms or

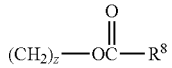

wherein z is an integer from 0 to 6 and $R^8$ is an aliphatic hydrocarbyl moiety having 4 to 24 carbon atoms.

16. The lubricating oil composition of claim 15, wherein $R^1$, $R^2$ and $R^3$ of the glycerol ester are independently selected from an aliphatic hydrocarbyl moiety having 4 to 24 carbon atoms, wherein at least one of $R^1$, $R^2$ and $R^3$ is a saturated aliphatic hydrocarbyl moiety having 4 to 10 carbons atoms, and wherein at least one of $R^1$, $R^2$ and $R^3$ is an aliphatic hydrocarbyl moiety having from 11 to 24 carbon atoms.

17. The lubricating oil composition of claim 16 wherein the aliphatic hydrocarbyl moiety having from 11 to 24 carbon atoms is derived from a fatty acid selected from the group consisting of oleic acid, eicosenoic acid and erucic acid.

18. The lubricating oil composition of claim 15 wherein the glycerol ester is canola oil and the non-glycerol ester is a trimethyloipropane (TMP) ester selected from the group consisting of TMP tri(2-ethyl hexanoate), TMP triheptanoate (TMPTH), TMP tricaprylate, TMP tricaprate, TMP tri (isononanoate) and TMP trioleate.

19. The lubricating oil composition of claim 15 wherein the glycerol ester is canola oil and the non-glycerol ester is TMPTH.

20. The lubricating oil composition of claim 1, wherein the composition has an SAE Viscosity Grade of 0W, 0W-20, 0W-30, 0W-40, 0W-50 , 0W-60, 5W, 5W-20, 5W-30, 5W-40, 5W-50, 5W-60, 10W, 10W-20, 10W-30, 10W-40, 10-50, 15W, 15W-20, 15W-30 or 15W-40.

21. The lubricating oil composition of claim 1, having a phosphorous content not exceeding 0.05 wt. %, based on the total weight of the composition.

22. The lubricating oil composition of claim 1, further comprising at least one additive selected from the group consisting of metallic detergents, ashless dispersants, friction modifiers, extreme pressure agents, viscosity index improvers and pour point depressants such that the phosphorous content of the lubricating oil composition is no greater than 0.08 wt. % and the sulfur content of the lubricating oil composition is no greater than 0.2 wt. %, based on the total weight of the composition.

* * * * *